US012575659B2

(12) United States Patent
Guizzetti et al.

(10) Patent No.: US 12,575,659 B2
(45) Date of Patent: Mar. 17, 2026

(54) METHOD FOR FORMING A STICK FOR LIPS, A MACHINE FOR FORMING STICKS FOR LIPS, AND A PRODUCT FOR LIPS MADE USING THIS METHOD

(71) Applicant: CHROMAVIS S.p.A., Offanengo (IT)

(72) Inventors: Giorgio Guizzetti, Vimercate (IT); Mauro Gaboardi, Pizzighettone (IT); Sergio Valvassori, Ripalta Cremasca (IT)

(73) Assignee: CHROMAVIS S.p.A., Offanengo (IT)

( * ) Notice: Subject to any disclaimer, the term of this patent is extended or adjusted under 35 U.S.C. 154(b) by 790 days.

(21) Appl. No.: 17/533,318

(22) Filed: Nov. 23, 2021

(65) Prior Publication Data

US 2022/0160103 A1 May 26, 2022

(30) Foreign Application Priority Data

Nov. 24, 2020 (IT) ..... 102020000028160

(51) Int. Cl.
*A45D 40/16* (2006.01)
*A45D 40/00* (2006.01)

(52) U.S. Cl.
CPC ..... *A45D 40/16* (2013.01); *A45D 2040/0031* (2013.01)

(58) Field of Classification Search
CPC ..... A45D 40/16; A45D 40/00; B29C 33/00
See application file for complete search history.

(56) References Cited

U.S. PATENT DOCUMENTS

| | | | | |
|---|---|---|---|---|
| 6,116,801 | A * | 9/2000 | Patel | A45D 40/06 401/78 |
| 6,158,911 | A | 12/2000 | Seebach, Jr. et al. | |
| 6,290,414 | B1 * | 9/2001 | Seebach, Jr. | A45D 40/16 401/78 |
| 2002/0130442 | A1 * | 9/2002 | Statham | B29C 39/02 249/117 |
| 2014/0130457 | A1 * | 5/2014 | Lebert | A45D 40/16 53/510 |
| 2017/0258200 | A1 * | 9/2017 | Rossi | A45D 40/20 |
| 2018/0070703 | A1 | 3/2018 | Kikuchi et al. | |
| 2018/0255906 | A1 * | 9/2018 | Delia | A45D 40/00 |
| 2020/0163440 | A1 | 5/2020 | Chartier et al. | |

FOREIGN PATENT DOCUMENTS

| | | | |
|---|---|---|---|
| EP | 0686468 | A1 | 12/1995 |
| EP | 3603921 | A1 * | 2/2020 |
| EP | 3701831 | A1 | 9/2020 |
| GB | 1039085 | A | 8/1966 |
| IT | 201800010508 | A1 | 5/2020 |

* cited by examiner

*Primary Examiner* — Susan D Leong
(74) *Attorney, Agent, or Firm* — Dickinson Wright PLLC; Andrew D. Dorisio; Nicholas P. Coleman

(57) ABSTRACT

A method for forming a stick for lips includes positioning a mould (2) made of an elastic material, such as silicone, on a first support (11), the said mould comprising a casting cavity (4) endowed with an opening (5). The method further includes centring a cup (3) in the casting cavity (4) opening (5), pouring a melted cosmetic product through the cup (3) and into the casting cavity (4), waiting for the solidification of the melted cosmetic product in the casting cavity (4) so as to form the stick, and extracting the stick (7) from the cavity by gripping the cup (3).

11 Claims, 4 Drawing Sheets

METHOD FOR FORMING A STICK FOR LIPS, A MACHINE FOR FORMING STICKS FOR LIPS, AND A PRODUCT FOR LIPS MADE USING THIS METHOD

This application claims priority to Italian Patent Application for Invention No. 102020000028160 filed on Nov. 24, 2020, the disclosure of which is incorporated herein by reference.

FIELD OF THE INVENTION

The present invention relates to a method for forming a stick for lips, a machine for forming sticks for lips, and a product for lips made using this method. In particular, it refers to a stick for lips such as lipstick, lip balm, and the like.

BACKGROUND

Sticks for lips (whether in stick or bulk form) are normally sold in special lipstick devices (also called lipstick machines, i.e. lipstick cases).

Commonly known lipstick devices comprise kinematic mechanisms that allow the stick to be extracted from the said protective case, normally by rotating or moving a part of the said device.

In the most commonly known lipstick devices, the rotation of a part of the handle with respect to a tubular body in which the stick is housed when in the non-use position causes the axial translation of a cup coupled to the said stick. In this way, the stick is pushed out of the tubular body and can be used. Rotation in the opposite direction makes the cup (and therefore the stick for lips) retract into the tubular body when the stick no longer needs to be used. There may be a lid or cap which fits over the tubular element to protect the stick, for example when transported inside a handbag or other container.

Usually, the sticks are made by casting a melted cosmetic product which is either solid or has a pasty consistency at room temperature. For convenience, the casting is performed into silicone moulds.

The stick can be made either entirely or only partially inside the silicone mould.

Once the stick has solidified, the device (with the cup in the stroke limit position) is aligned with the pre-formed stick for lips, and the cup is fitted onto one end of the stick for lips. At this point the stick is extracted from the mould, pulling out the said stick using the device.

This operation is very delicate and imperfect centring of the device with respect to the stick can lead to the creation of unsightly smudges, which are completely unacceptable in high-end products. A product for lips that has smudges or imperfections must be discarded and in the event, both the device and the stick contained therein are discarded.

Given that the cost of the device is significant higher than the cost of producing the stick, discards of this kind have an extremely adverse impact on production costs.

It should be noted that the problem of centring the stick in the device is not easy to solve.

Indeed, for convenience, the stick is made in elastic moulds (made of silicone, as said earlier). Given the 'elastic' nature of the mould holding the stick, centring is often imperfect at the stick/device coupling step, even in machines with extremely advanced technology.

SUMMARY OF THE INVENTION

The object of the present invention is to overcome the drawbacks of the commonly known technique.

A further object of the invention is to provide a method, a machine, and a product for lips which reduce or eliminate the stick/device alignment or centring problems.

Yet another object of the invention is to reduce the production costs of commonly known products for lips by reducing the costs linked to discarding sticks for lips.

This and other objects are achieved by means of a method, a machine, and a product for lips produced according to the technical teachings of the appended claims.

One advantage of the invention is that it provides a more flexible method for marketing products for lips which is more centred on customers' needs, also in terms of customisation.

BRIEF DESCRIPTION OF THE FIGURES

Further characteristics and advantages of the invention will become apparent in the description of a preferred but not exclusive embodiment of the invention, illustrated—by way of a non-limiting example—in the drawings annexed hereto, in which.

DETAILED DESCRIPTION OF THE INVENTION

Figure 1:
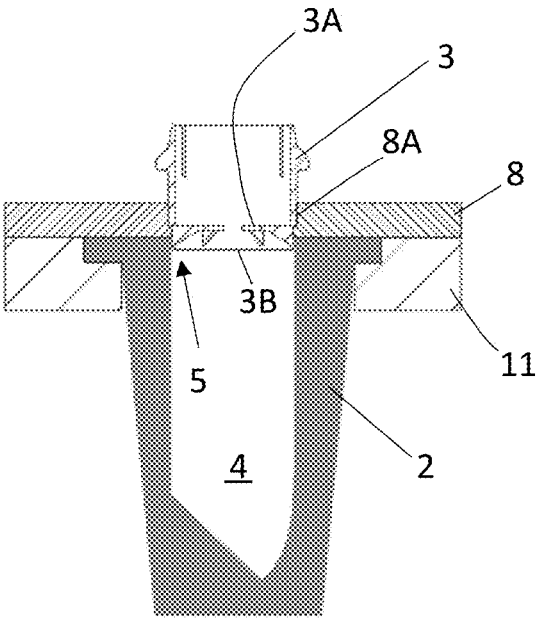
FIG. 1 is a simplified section view of a mould and certain parts of the machine according to the invention.

With reference to the figures stated, reference number 1 is used to denote, as a whole, a stick for lips.

The stick for lips is made employing a method that will better emerge in the description that follows.

In this text, the term 'stick for lips' (or 'lip crayon') refers to a cosmetic stick for lips such as a lipstick, lip balm, etc.

The moulding method comprises the step of arranging a mould 2 made of elastic material, preferably silicone, on a first support 11, the said mould comprising a casting cavity 4 endowed with an opening 5.

The mould 2 (soft-mould) is essentially of the conventional type and essentially reproduces a negative form of the final external shape of the stick for lips. It is generally obtained by solidification of an elastic product (e.g. silicone possibly with additive) in contact with a counter-mould the exterior of which is identical to the stick to be produced.

The support 11 can be made in the mobile plate of a machine 76 for forming sticks for lips.

Figure 12:
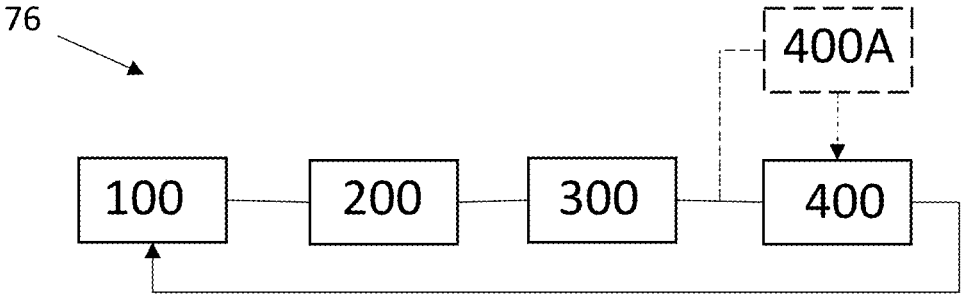
FIG. 12 shows, schematically, certain processing stations for a machine for forming sticks for lips.

It can be a (possibly removable) part of a turntable (or carousel) which moves in sequence along a closed route between several processing stations which are useful for forming the stick. Some of the processing stations envisaged in the moulding machine are illustrated schematically in FIG. 12, which shows a casting station 100, a cooling station 200, an extraction or unmoulding station 300, and a preparation station 400 for the mould 2 prior to casting.

Obviously, the machine can feature other processing stations, which will not be described because they are known to those skilled in the art.

According to the invention, the step in which a cup 3 is centred in the opening 5 of the casting cavity 4 in the mould 2 is implemented in the preparation station 400.

The step in which the cup 3 is centred in the opening of the casting cavity 4 can be implemented using a second support 8 endowed with a seat 8A with at least one guide 9 for centring the cup 3 on the second support.

The second support 8 can therefore be centred, in turn, with respect to the mould 2 and/or with respect to the first support 11 at least prior to the melted cosmetic product casting step.

For example, the preparation station 400 can feature an actuator which arranges and centres the cup 3 on the second support 8.

In this case, before casting (or the casting station 100), the second support 8 is already pre-positioned on the mould 2 (for example, it is centred on or locked to the first support 11) and the cup 3 is inserted into the seat 8A in the second support 8.

For example, a flange 2A of the mould can be sandwiched between the first support 11 and the second support 8, which can be mutually constrained by constraint systems (for example, of the magnetic variety) and by mutual centring means.

The actuator can then arrange the cup 3 directly in the seat 8A in the second support 8 just before the actual casting.

Alternatively, the preparation station 400 can pick up a support 8 (already equipped with a cup 3 in the seat 8A thereof) and position the second support 8 above the mould 2 (appropriately centring the said support).

The positioning and picking can be performed by an appropriate actuator.

In the case described above, a further station 400A can also be featured, which picks up the second support 8 once the stick has been extracted, inserts the cup 3 thereinto, and makes the second support 8 available to the preparation station 400.

Advantageously, when the cup 3 is centred over the opening 5 of the casting cavity 4, at least one free edge 3B of the cup can be located inside the casting cavity 4.

Regarding this, the cup can feature a step 3F which encounters a stop envisaged in correspondence with the seat 8A in the second support 8, which is suitably calibrated and which—when the second support 8 is in position over the mould—allows the free edge to protrude into the casting cavity 4.

Figure 7:
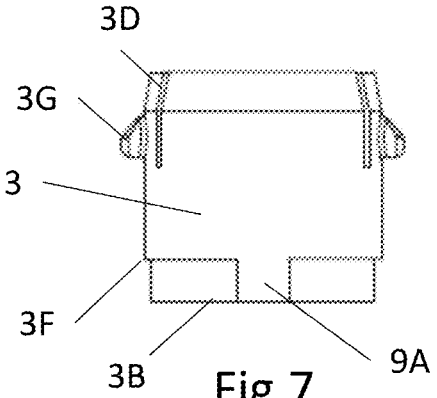
FIG. 7 is a side view of the cup in FIG. 6.
Figure 8:
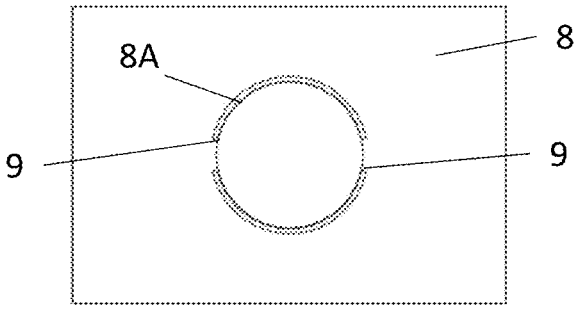
FIG. 8 shows a part of the machine which implements the method according to the present invention.
Figure 9:
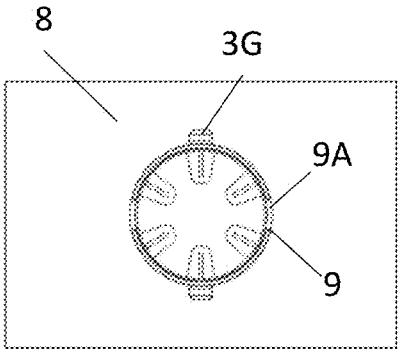
FIGS. 9 and 10 are alternative forms of the machine part shown in FIG. 8, when coupled to the cup.
Figure 10:
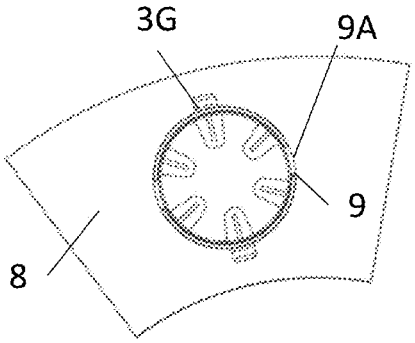

Furthermore, the cup 3 can be shaped so as to have at least one counter-guide 9A which couples to the guide 9 on the second support 8 (see FIGS. 7 and 8). In this way, as can be seen for example in FIGS. 9 and 10, the pins 3G on the cup (the usefulness of which will be clarified below) will be oriented in a predetermined manner with respect to the second support 8).

After preparing the mould 2 as above described, the method envisages a step consisting of pouring a melted cosmetic product into the casting cavity 4 through the cup 3.

The melted cosmetic product can be a cosmetic product suitable for making sticks for lips which takes on an essentially liquid consistency at high temperatures (such as 90° C.), and takes on a solid consistency when brought back to room temperature (25° C.).

Figure 2:
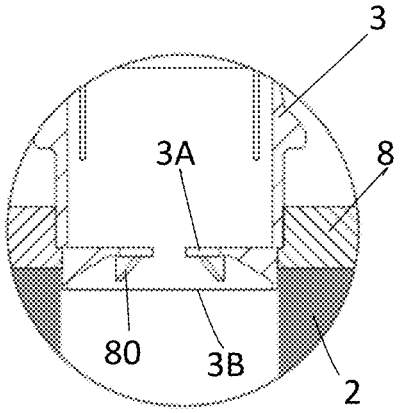
FIG. 2 is an enlargement of a detail in FIG. 1.
Figure 6:
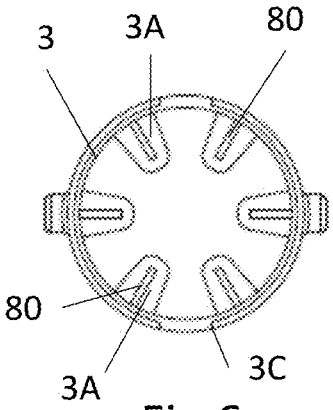
FIG. 6 is a top-down view of a cup used in the method according to the present invention.

The cup 3 can feature at least one projection 3A, which extends from an internal perimeter of the said cup 3 (for example, jutting out horizontally) facing an axis of symmetry of the said cup. Several horizontally jutting projections 3A can be envisaged, as shown in FIG. 6, and each projection 3A can feature one or more stiffening ribs 80 (see also FIG. 2).

The projection 3A can also have a continuous planar configuration consisting of, for example, a mesh which occupies all or at least part of the cup opening.

Figures 3A, 3B, 3C:
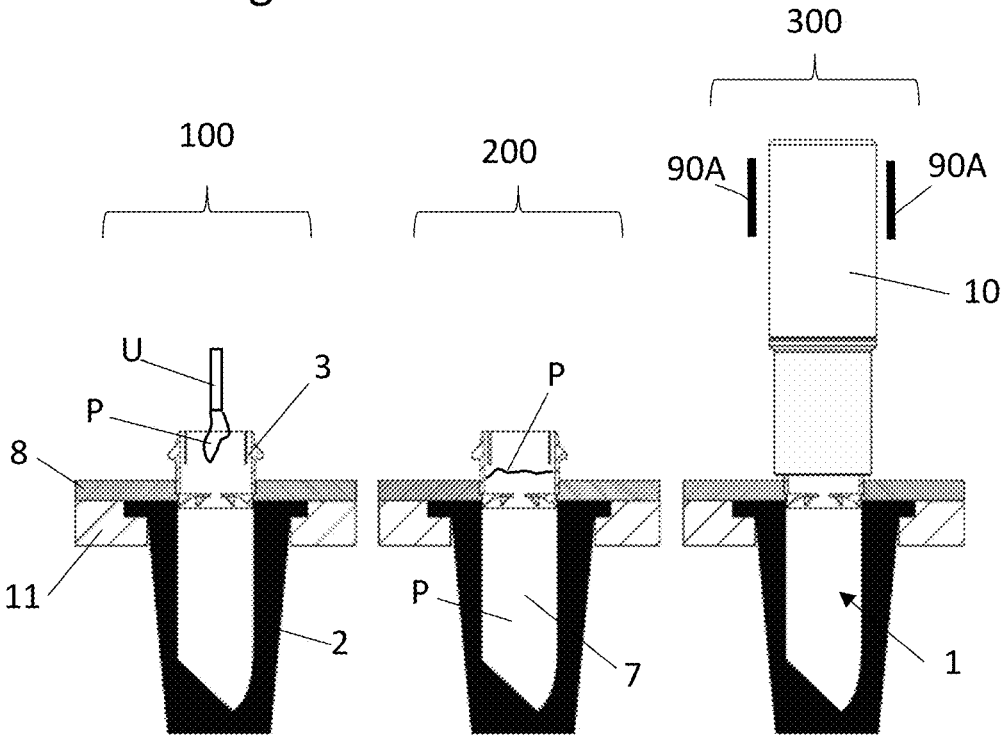
FIGS. 3A, 3B, and 3C show certain steps in the method according to the present invention.

In the presence of the projection(s) 3A, the step of pouring the melted cosmetic product through the cup can be performed by covering the at least one projection 3A (as can be seen in FIG. 3B, in which the uncovered surface of the product P is clearly visible) with the melted cosmetic product so that the projection remains embedded (possibly in an undercut manner) in the solidified cosmetic product once the stick 7 has been formed.

In this way, the stick 7 (consisting of the cosmetic product in a solid state) remains firmly coupled to the cup 3, forming a single body 1.

The pouring can be performed via a nozzle U (see FIG. 3A), which allows the melted cosmetic product P to run out from above the cup. The nozzle U can also penetrate the cup 3 at least partially (during casting) or even penetrate the mould 2 (via the cup 3). The nozzle U can also move during casting, for example, translating vertically to optimise mould filling.

After casting, the method envisages the solidification of the melted cosmetic product in the casting cavity 4 in order to form the stick.

As already mentioned, where necessary, a cooling station 300 (for example refrigeration, air-cooling) can be featured, through which the mould runs, cooling from the outside in, so as to enable more rapid cooling and consequent solidification of the melted cosmetic product, which thus forms the stick.

The further step in the method envisages the extraction of the stick 7 from the cavity by gripping the cup 3.

The extraction step can envisage the creation of a vacuum outside the mould 2, which makes the said mould expand (thereby releasing the stick) once the cup 3 is gripped and held in position.

Figure 4A:
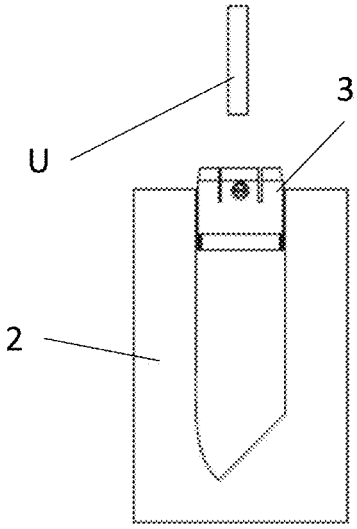
FIGS. 4A, 4B, and 4C show, schematically, further steps in the method according to the present invention.
Figure 4B:
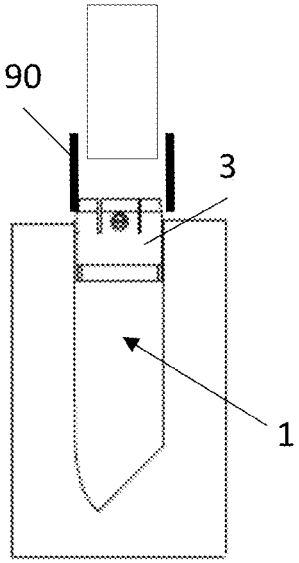
Figure 4C:
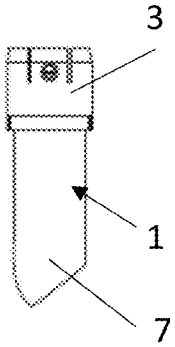

The cup can be gripped by grippers 90 (FIGS. 4B, 4C) which extract the stick 7 (i.e. the solidified cosmetic product) and the cup 3, which have now become a single body 1 (hereinafter also referred to as a "mobile element" when relating to a lipstick device 10, or more simply a stick).

Figure 5:
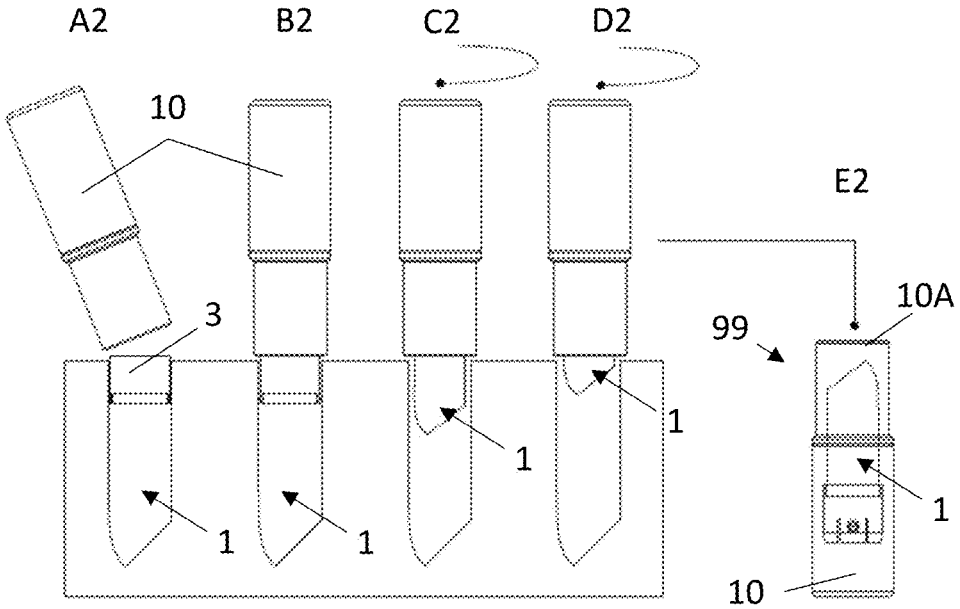
FIG. 5 shows certain possible steps in the method according to the present invention whose aim is to produce a product for lips.

The grippers 90 can place the extracted stick (and cup) in a temporary housing 91 (FIG. 5). For example, the temporary housing 91 can be configured to protect the pasty part of the stick, which can be supported by the cup.

Figure 11A:
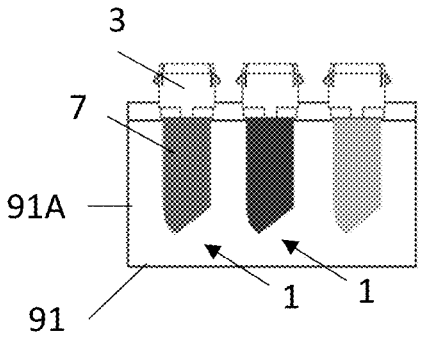
FIGS. 11A-11D schematically show a possible use of a stick for lips made according to the present invention.

Sticks with different characteristics and colours can be housed in the temporary housing 91 (see also FIG. 11A). The colours are visible through at least one transparent wall 91A of the housing 91.

Figure 11B:
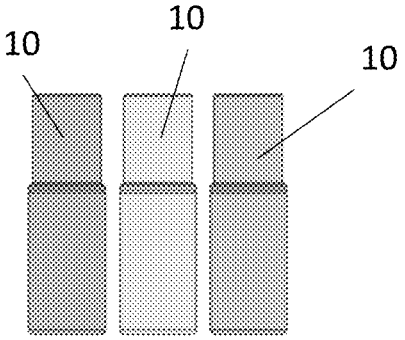

The temporary housing can, for example, be displayed or stored in a shop, together with a plurality of stick devices with different characteristics and finishes (FIG. 11B) devoid of the cup.

The method can therefore envisage a step in which the stick 7, once extracted from the mould (together with the cup), is coupled to the lipstick device 10 (or lipstick machine or lipstick case) chosen by the end user immediately prior to the sale.

Figure 11C:
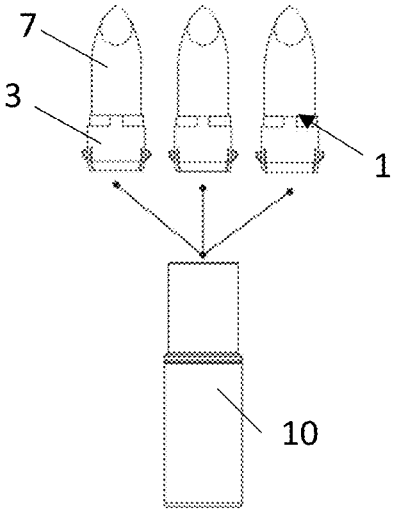

In this way, a single device with finishes and features chosen by the user can be coupled to the single body 1 with the desired characteristics (FIG. 11C) chosen immediately prior to the sale.

In this text, the concept 'immediately prior to the sale' means that the coupling between device and the stick can be performed in the presence of the customer in a store, or by customising a device with a specific stick once it has been ordered by a customer, for example following an order, which may even be placed online.

A possible method by which the cup and the device are coupled is illustrated by way of example in FIG. 5.

For example, the lipstick device 10 is inclined (A2) to engage or couple it to the cup, which is designed (or configured) to hook onto the said lipstick device 10.

For example, the lipstick device 10 (or lipstick machine or lipstick case) can feature suitable guides which house the pins 3G featured on the cup. Advantageously, the pins 3G are fitted onto flexible flaps on the cup 3 made via notches 3D, to facilitate a snap-fit engagement with the lipstick device guides.

In this way, the said pins 3G can be moved in order to fit properly into the guides on the lipstick device 10 when it is coaxial to the stick 1 (FIG. 5, ref. B2).

At this point the handle of the device is rotated, thereby retracting the stick thereinto (FIG. 5, ref. C2 and D2), advantageously keeping the lipstick device 10 properly aligned with the stick.

Once the rotation of the handle is completed, the stick is housed entirely within the lipstick device and the cap 10A can be placed in position (ref. E2).

At this point, the product for lips 99 (made up of a lipstick device 10 and stick 7 coupled to the cup 3) can be inserted into a secondary packaging (if envisaged) and sold to the customer.

The method described above can also be particularly effective for the production of sticks for lips marketed according to conventional channels and methods.

In this case, once the stick 7 is solidified, the cup 3 is gripped as coupled onto a lipstick device 10 (devoid of a cup) before the stick is extracted from the mould. Therefore, unlike the method described above, the stick for lips 7 is extracted from the mould by means of the lipstick device 10 which is fastened (exactly as described above, for example, by a snap-fit mechanism) to the cup 3.

It is therefore the said lipstick device 10 that is moved to and from the mould by the grippers 90A of, for example, an actuator.

In the present description, the term "actuator" has been used to refer to a system which performs a very precise movement along any two-dimensional or three-dimensional route. An example of an actuator could be a mechanical arm, or a kinematic mechanism specially made to carry out pre-programmed movements.

In the present wording, the term "gripper" means any means capable of firmly grasping and releasing the cup and/or the device on command. For example, to grip the device, the grippers can be of the kind featuring suction cups etc. If the cup has to be gripped, on the other hand, the grippers can have a particular shape essentially corresponding to that of the said cup.

It should be noted that the method can also envisage the stick being extracted from the mould (gripping the stick by means of the cup) and being coupled to the device later on, however always during a production step, not a sales step.

In this way, for example, the said machine can extract the stick from the mould using special grippers (gripping the stick by means of the cup). Then, the said machine couples the stick and the device. This method would separate the supply of devices to the machine, for example by creating a buffer containing the ready formed sticks (plus cup) extracted from the mould.

A machine for forming stick for lips has therefore been described which operates by means of the method according to the present invention.

Obviously, this machine may feature other parts or 'stations' which can be used to perform other actions on the mould or on the stick which are useful for the formation thereof and are known to those skilled in the art (e.g. re-melting the surface that comes into contact with air after casting, lubrication, and cleaning the moulds with blowing or other commonly known techniques, preheating the moulds prior to casting, etc.).

As already mentioned, the machine can feature a turntable in a fixed location (to house a plurality of moulds) or a carousel of supports (for the moulds) that can be moved along a closed route. Obviously, the machine may be able to process several sticks simultaneously in each station, for example in groups of 2, 4, 6, 8 and so on.

Essentially, the machine 76 for forming stick for lips comprises:

a. a first support (11) for a mould (2) made of an elastic material, preferably silicone, which comprises a casting cavity (4) endowed with an opening (5),
b. means for centring a cup (3) in the casting cavity (4) opening (5),
c. means for pouring a melted cosmetic product through the cup (3) and into the casting cavity (4),
d. means for accelerating solidification of the melted cosmetic product in the casting cavity (4) so as to form the stick, and
e. means for extracting the stick (7) from the cavity by gripping the cup (3).

Figure 11D:
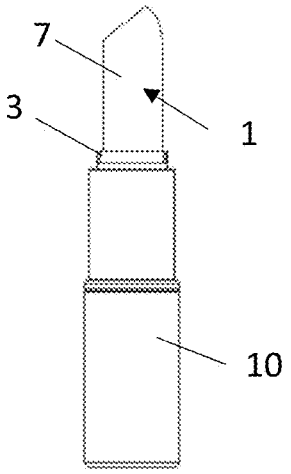

A product for lips has also been described (FIG. 11D), comprising a stick for lips made using the method and/or machine described above.

Therefore, the product for lips described here can feature a stick 1 formed of part of a cosmetic product which is solid at room temperature and a cup which is an integral part of the stick. As mentioned earlier, part of the cup (specifically the at least one projection 3A) can also be incorporated, in an undercut manner, into the solidified cosmetic product.

Alternatively, the cup can be devoid of any projections (or at least projections in contact with the cosmetic product), and the coupling between the cup and the cosmetic product can be achieved through merely adhesion of the latter to the cup wall in contact with the cosmetic product.

The invention also relates to a single body 1 formed of the mutually constrained stick 7 and cup 3, formed by means of the method and/or the machine described above.

The advantages of the method, of the machine, and of the product for lips made according to the present invention are clear from the description above. The advantages are summarised below.

In the commonly known technique, the stick of lipstick (or other product for lips in a stick form) is attached to the device by means of a plastic component called a cup, which is pre-assembled on the machine. The cup can be moved up or down via appropriate kinematic mechanisms and is always linked to the device.

The present method overcomes or minimises certain problems related to the commonly known technique. In particular, the method, the machine, and the product for lips according to the present invention ensure better alignment of the cup and the stick.

In fact, with the commonly known technique (during the soft-mould process in particular but this also applies to metal moulds), when the stick is being picked up directly using the device, if the stick and the cup already fastened to the device are not perfectly aligned, a smudge of product is formed on one side of the cup. Furthermore, the stick will be off-centre and could touch the mechanism of the device on the internal wall of the shaft.

This problem is minimised or solved by the present invention because the cup/stick alignment (or rather the alignment of the cup and the mould in which the stick is formed) occurs prior to casting the said melted product which, once solidified, will form the stick.

The present invention also minimises the problems which could originate in the event of deformation of the soft mould. Indeed, during use, the nose cone (mould) tends to deform, usually expanding, and creates a smudge around the cup.

Furthermore, the stick may be fitted into the cup less firmly than desired as it might not be at the height envisaged (could be lower, as the mould can deform).

Problems related to stick/device axis alignment are also minimised.

During picking in conventional machines, the stick can tilt and therefore shift out of axis with the mechanism, even without smudging, resting on the internal wall of the shaft of the mechanism.

Furthermore, the present invention minimises the problems originating from unstable picking of the device.

During conventional picking, the device can slip and the fitting height (of the cup onto the stick) may not be constant (jeopardising the appearance and the drop test results). Furthermore, a stick that is too hard or too soft can also jeopardise the said picking, creating rejects or broken sticks.

All these drawbacks are overcome or minimised by the invention described above.

Therefore, rejects are minimised (compared to commonly known methods). This point is particularly important as the devices (which are sometimes extremely costly) cannot be cleaned and salvaged in the event of smudges, misalignments, or the other problems experienced with the commonly known technique as described above.

Last but not least is the stick seal resistance in the tap-tap test or the drop test. In the commonly known technique, the seal (fastenings) between the stick and the cup depends entirely on the friction between the contacting surfaces of the stick and the cup. It should be remembered that in the commonly known technique, the cup is fitted (and therefore by interference alone) onto a ready-formed stick (or crayon).

According to the present invention, the stick product is poured and solidifies when it comes into contact with the cup. And this already guarantees a better seal between the stick and the cup since the surface of the cup is dampened by the melted product and therefore adhesion is perfect when the latter solidifies.

In the presence of at least one flap (projection 3A) embedded in the stick, the stability of the coupling is further improved.

Additional benefits include the following:

a—possibility of selling the stick with a cup for packaging customisation in the store;

b—if there are any rejects, only the cup is rejected and not the whole mechanism (device), with consequent minimisation of the cost of the individual reject;

c—casting through the cup solves drop test problems and improves cup/stick adhesion compared to conventional methods;

d—Savings in the bulk product (the melted cosmetic product) as the bottom of the stick (the part which is unusable as contained within the cup) can be much shorter.

Various embodiments of the innovation have been disclosed herein, but further embodiments may also be conceived using the same innovative concept.

The invention claimed is:

1. Method of forming a lip stick, comprising the steps of:

a. arranging on a first support (11) a mold (2) made of elastic material, which comprises a casting cavity (4) equipped with an opening (5), b. centering a cup (3) on the opening (5) of the casting cavity (4), wherein said centering takes place through a second support (8) equipped with a seat (8A) with at least one guide (9) for the centering of the cup (3), the second support (8) being centered with respect to the mold (2) or with respect to the first support (11), wherein the cup (3) defines a longitudinal axis and includes a plurality of projections (3A) extending from an internal perimeter of the cup perpendicular to the longitudinal axis, each of the plurality of projection (3A) including one or more stiffening ribs 80 spaced apart from a sidewall of the cup and extending in a longitudinal direction along the longitudinal axis, c. subsequent to centering the second support (8) with respect to the mold (2) or with respect to the first support (11), pouring a molten cosmetic product through the cup (3) into the casting cavity (4), d. waiting for the molten cosmetic product to solidify in the casting cavity (4) to form the lip stick, e. extracting the lip stick (7) from the cavity by grasping the cup (3), the cup (3) being configured to hook onto a lipstick device (10).

2. Method according to claim 1, wherein, when the cup (3) is centered at the opening (5) of the casting cavity (4), at least one free edge (3B) of the cup is inside the casting cavity (4).

3. Method according to claim 1, wherein the cup (3) has at least one projection (3A) extending from an internal perimeter of the cup (3) itself, and the step of pouring the melted cosmetic product through the cup is carried out covering the at least one plurality of projections (3A) with the melted cosmetic product so that the at least one plurality of projections remain incorporated in a solidified cosmetic product when the lip stick is formed.

4. Method according to claim 1, in which a solidification of a melted cosmetic product is accelerated by cooling the mold (2) made of elastic material from the outside.

5. Method according to claim 1, in which, before casting, the second support (8) is already pre-positioned on the mold (2) and the cup (3) is inserted in the seat (8A) of the second support (8).

6. Method according to claim 1, in which, before casting, the cup (3) is inserted into the seat (8A) of the second support (8) and subsequently the second support positioned above the mold (2).

7. Method according to claim 1, wherein the cup (3) is grasped by hooking it to the lipstick device (10).

8. Method according to claim 1, wherein the lip stick (7) extracted from the mold is coupled to the lipstick device (10) only immediately prior to the sale.

9. The method of claim 1, wherein the seat (8A) is in the form of a recess.

10. The method of claim 1, wherein the cup comprises a counter-guide (9A) adapted to mate with the at least one guide of the second support so as to fix a rotational movement of the cup with respect to the second support.

11. The method of claim 1, wherein the second support (8) is centered with respect to the first support (11).

* * * * *